United States Patent [19]

Tabata et al.

[11] Patent Number: 4,808,989

[45] Date of Patent: Feb. 28, 1989

[54] DISPLAY CONTROL APPARATUS

[75] Inventors: Kuniaki Tabata, Tokyo; Tetsuo Machida, Sagamihara; Masatoshi Hino, Yokohama; Kunihiro Nomura, Kawasaki, all of Japan

[73] Assignee: Hitachi, Ltd., Tokyo, Japan

[21] Appl. No.: 809,905

[22] Filed: Dec. 17, 1985

[30] Foreign Application Priority Data

Dec. 22, 1984 [JP] Japan ..... 59-269664

[51] Int. Cl.[4] ..... G09G 1/00

[52] U.S. Cl. ..... 340/750; 340/703; 340/798

[58] Field of Search ..... 340/721, 747, 750, 798, 340/725, 723, 701, 703

[56] References Cited

U.S. PATENT DOCUMENTS

| | | | |
|---|---|---|---|
| 3,996,584 | 12/1976 | Plager | 340/790 |
| 4,232,376 | 11/1980 | Dion et al. | 340/750 |
| 4,489,317 | 12/1984 | Shiga | 340/750 |
| 4,509,043 | 4/1985 | Mossaides | 340/750 |
| 4,533,910 | 8/1985 | Sukonick et al. | 340/798 |
| 4,542,376 | 9/1985 | Bass et al. | 340/721 |
| 4,561,659 | 12/1985 | Redfield et al. | 340/721 |
| 4,566,000 | 1/1986 | Goldman et al. | 340/750 |
| 4,649,380 | 3/1987 | Penna | 340/703 |
| 4,712,099 | 12/1987 | Maeda | 340/703 |

*Primary Examiner*—Gerald L. Brigance
*Assistant Examiner*—Mahmoud Fatahi-yar
*Attorney, Agent, or Firm*—Antonelli, Terry & Wands

[57] ABSTRACT

A display control apparatus comprises area specifier, area determiner and signal selector. The area specifier specifies at least one area of a bit map memory. The area determiner determines whether the scan position on the bit map memory is in the specified area or not, and, according to the determination, controls the signal selector so as to send the output of the bit map memory directly or through a look-up table to a display unit. In a modification, the signal selector selects the signal to be sent to the display unit from among the outputs of different look-up tables.

9 Claims, 6 Drawing Sheets

DISPLAY CONTROL APPARATUS

BACKGROUND OF THE INVENTION

The present invention relates to a display control apparatus, particularly to a control apparatus for a raster scan type display having a bit map memory and one or more look-up tables.

In many of the raster scan type displays having a bit map memory, a look-up table (also referred to as a video look-up table, a color table or a color map, and hereinafter abbreviated as LUT) is used (for instance, refer to A. Van Dam "Fundamentals of Interactive Computer Graphics" pp. 129–135, Addison - Wesley, 1982). A LUT is a kind of conversion table, and it converts the data read out from a bit map memory as a refresh buffer, using that data as the table index, to the signals for controlling the luminance or color of a CRT. In addition , a system is known in which the data from a bit map memory is directly utilized as the luminance signals or color signals (red, green and blue) for a CRT without passing through a LUT.

In the conventional display, only one or the other of converted display which uses a LUT and direct display which does not use a LUT is selected for the whole of a bit map memory. However, in some cases, it is desirable that converted display which uses a LUT is selected for some area in a bit map memory and direct display which does not use a LUT is selected for the other area. For instance, when an image generated by computer graphics and a landscape image photographed by a camera are superimposed for display, it is convenient that the former image stored in some area in a bit map memory is displayed after the conversion by a LUT and the latter image stored in the other area is directly displayed without using a LUT. Such combination of converted display and direct display on a single screen has many applications, and is expected to contribute to the enrichment of image processing technique. Further, the superimposition of images converted in different ways by different LUTs is also useful.

SUMMARY OF THE INVENTION

An object of the present invention is to provide an apparatus which implements, in a raster scan type display having a bit map memory and a LUT, the combination on a single screen of converted display which uses a LUT and direct display which does not use a LUT.

A further object of the present invention is to provide an apparatus which implements, in a raster scan type display having a bit map memory and a plurality of LUTs, the combination on a single screen of images converted by different LUTs.

A further object of the present invention is to provide an apparatus with the foregoing capability of simple construction.

A still further object of the present invention is to provide an apparatus which permits varied combinations of converted display which uses a LUT and direct display which does not use a LUT, or of images converted by different LUTs.

In an aspect of the present invention, a raster scan type display having a bit map memory and LUT is provided with area specifying information holding means, area determining means and signal selecting means. The area specifying information holding means holds information which specifies at least one area of the bit map memory. The area determining means determines whether the scan position on the bit map memory is in the specified area or not, and controls the signal selecting means according to the determination so as to send the output from the bit map memory to a display unit directly or through the LUT.

In another aspect of the present invention, a plurality of LUTs are provided, and, under the control of the area determining means, the signal selecting means selects the output from one of LUTs to send it to the display unit.

According to the present invention, a converted display which uses an LUT or direct display which does not use an LUT can be selectively applied to the various areas of a bit map memory, or the conversions by different LUTs can be selectively applied to those areas. Accordingly, varied display is available, and the technique of computer image processing can be enriched. In addition, the apparatus of the present invention is simple as compared with the apparatus which stores different kinds of image data in different memories and performs the superimposing operation at a video signal level.

DESCRIPTION OF THE PREFERRED EMBODIMENT

Figure 1:
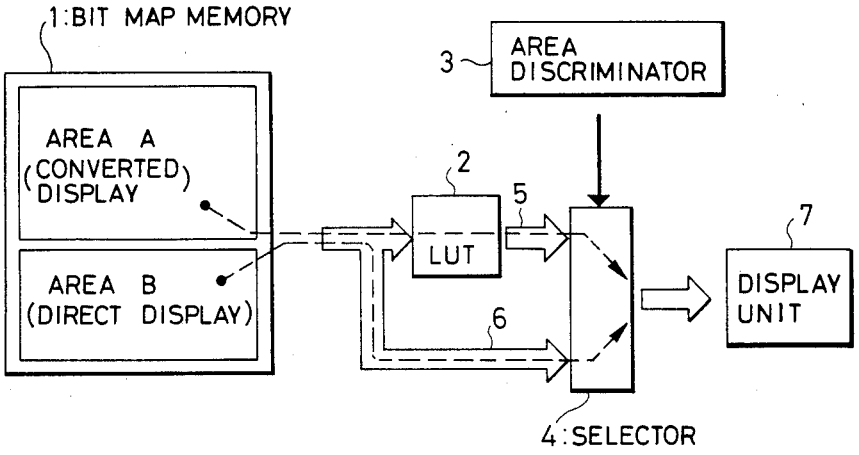
FIG. 1 is a schematic block diagram for depicting the concept of the present invention.

FIG. 1 schematically shows the concept of the present invention. An area A of a bit map memory 1 is for converted display which uses an LUT 2, and an area B is for direct display which does not use the LUT 2. While the bit map memory 1 is scanned and picture element data are successively read out, an area discriminator 3 examines whether the scan is in the area A or in the area B, and it switches a selector 4 according to the result. If the area A is under scanning, converted display is carried out by selecting the output 5 of the LUT 2 and sending it to a display unit 7, and if the area B is under scanning, direct display is carried out by selecting the direct output 6 from the bit map memory 1 and sending it to the display unit 7. In another aspect of the present invention, the area B is for converted display which uses a second LUT, and the output 6 from this area is sent to the selector 4 through said second LUT (not shown).

Figure 2:
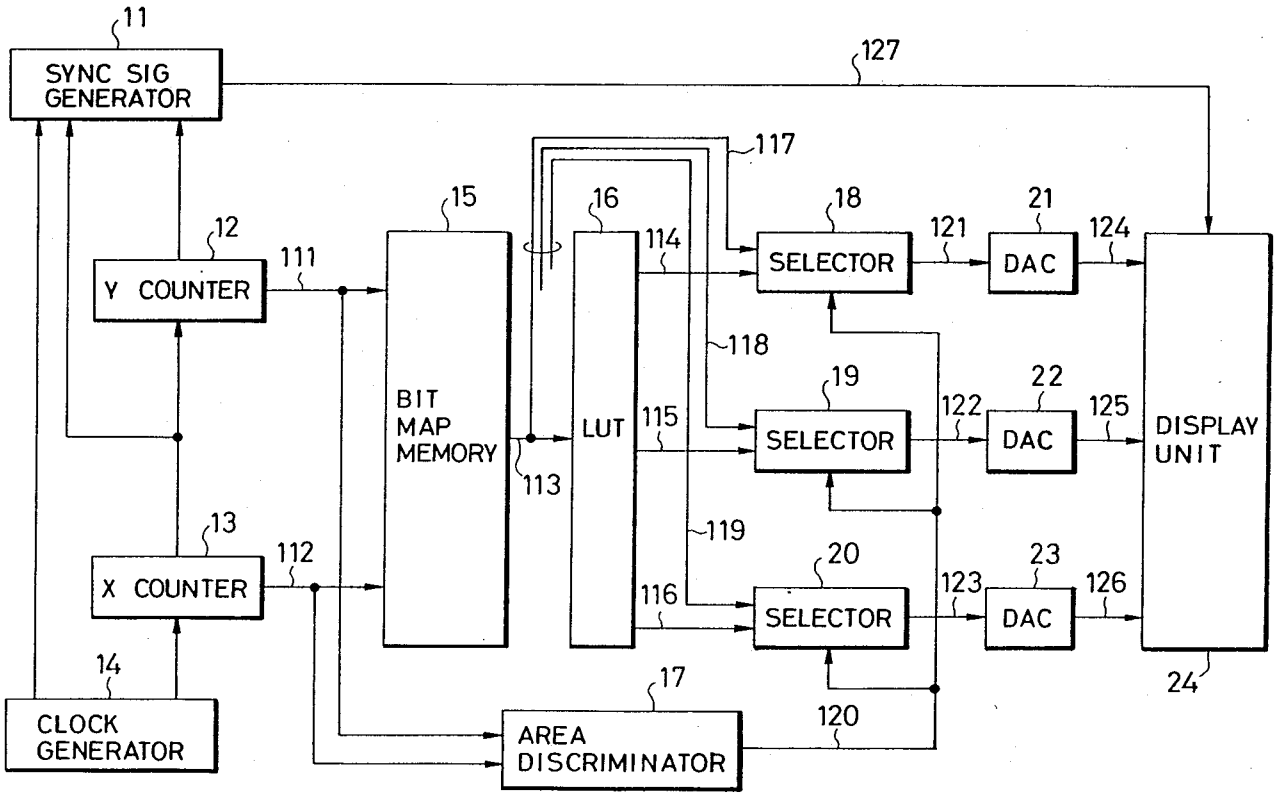
FIG. 2 is a block diagram for showing an embodiment of the present invention.

FIG. 2 shows an embodiment of the present invention. In summary, this embodiment comprises a synchronizing signal generator 11, a Y counter 12, an X counter 13, a clock generator 14, a bit map memory 15, a LUT 16, an area discriminator 17, selectors 18–20, digital-to-analog converters (DACs) 21–23 and a display unit (e.g. CRT) 24.

The X counter 13 receives clock pulses from the clock generator 14 to increment the X (column) address 112 for the bit map memory 15 one by one. The capacity of the X counter 13 is equal to the number of the columns of the bit map memory 15 (the number of the picture elements on a scanning line). The contents of the Y counter 12 are incremented one by one by the overflow output of the X counter 13. The Y counter 12 has a capacity equal to the number of the rows of the bit map memory 15 (the number of the scannning lines on the screen), and it supplies the Y (row) address 111 for the bit map memory 15. The location of a picture element to be read out from the bit map memory 15 is specified by the combination of the X address 112 and the Y address 111. The synchronizing signal generator 11 receives the outputs of the clock generator 14, X counter 13 and Y counter 12 to generate synchronizing signals (a horizontal synchronizing signal, a vertical synchronizing signal and the like) 127 for the raster scan. With the above mechanism, the contents of the bit map memory 15 are successively scanned in the X and Y directions and read out in synchronism with the raster scan of the display unit 24.

Figure 3:
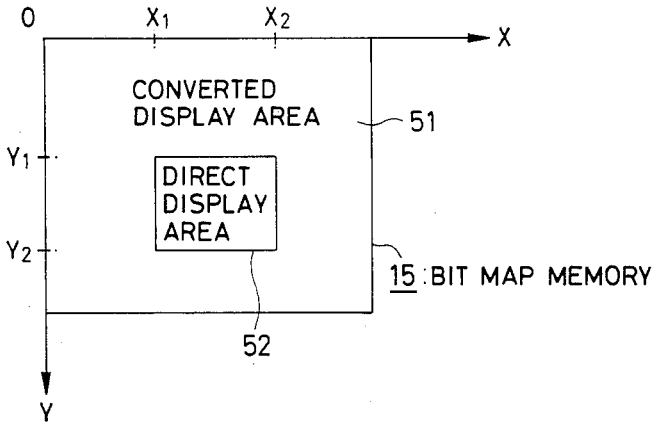
FIG. 3 is an illustration for depicting the coordinates of an area of a bit map memory.

FIG. 3 shows an example of the allocation of areas in the bit map memory 15. A direct display area 52 is a rectangle which is defined by X coordinates (X addresses) Xl, X2 and Y coordinates (Y addresses) Y1, Y2. That is, the information at a location which has an X address between Xl and X2 and a Y address between Y1 and Y2 is directly displayed without being converted by the LUT 16. The other area 51 is a converted display area, and the information in this area is displayed after it is converted by the LUT 16. For simplicity, FIG. 3 shows a case where only one direct display area and one converted display area exist. A plurality of direct display areas and/or converted display areas may exist.

Figure 4:
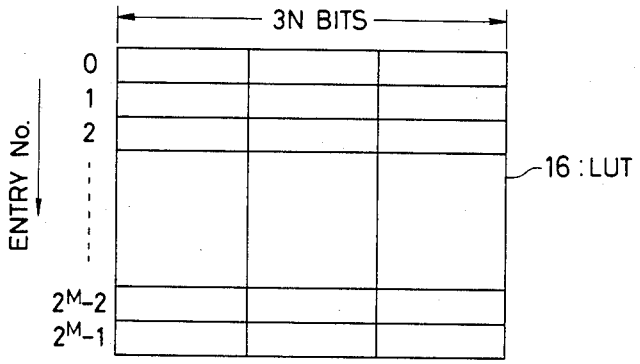
FIG. 4 is an illustration for showing the table construction of a LUT.

The bit map memory 15 has a depth of M-bits ($M \geqq 1$). In other words, the length of each picture element data is M bits. The M-bit data 113 read out from the bit map memory 15 is used as the table index for the LUT 16. As shown in FIG. 4, the LUT 16 has $2^M$ entries, and each entry consists of 3N bits ($N \geqq 1$). When the M-bit data read out from the bit map memory 15 is generally expressed in binary notation as ($b_{M-1} \ldots b_2 b_1 b_0$), the value $$V = \sum_{k=0}^{M-1} b_k \cdot 2^k \; (b_k = 1 \text{ or } 0)$$

constitutes the table index for the LUT 16, and, in response to this, the contents (3N bits) of the No. V entry are read out. This 3N-bit data is divided into three portions (114–116) each consisting of N bits, and they are supplied to the three selectors 18–20, respectively.

The data read out from the bit map memory 15 is also directly supplied to the selectors 18–20 without passing through the LUT 16, as shown by reference numerals 117–119. The selectors 18–20 select the signals 114–116 having passed through the LUT 16 or the signals 117–119 direct from the bit map memory 15 and supply them to the DACs 21–23, which. convert the outputs of the slectors 18–20 to analog signals 124–126 of R (red), G (green) and B (blue), respectively, and send them out to the display unit 24. The display unit 24 presents colored display in response to these R, G and B signals and the synchronizing signal 127 from the synchronizing signal generator 11.

The selectors 18–20 are controlled by the output signal 120 of the area discriminator 17. In more detail, these selectors select the signals 114–116 having passed through the LUT 16 or the signals 117–119 direct from the bit map memory 15 according as the logical state of the signal 120 is "0" or "1".

Figure 5:
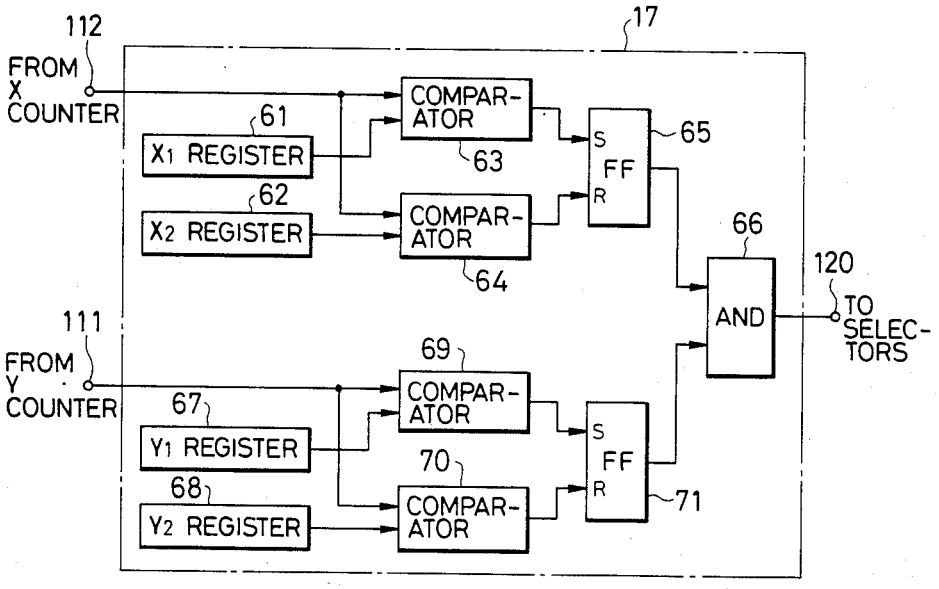
FIG. 5 is a block diagram of the area discriminator in FIG. 2.

FIG. 5 shows the detail of the area discriminator 17. In the Xl register 61, X2 register 62, Y1 register 67 and Y2 register 68, the coordinates (addresses) Xl, X2, Y1 and Y2 specifying the position of the direct display area 52 are preset, respectively. The values of the X address 112 and the Y address 111 for reading out from the bit map memory 15 are updated as the raster scan proceeds. A comparator 63 compares the value of the X address 112 with the contents of the Xl register 61, and sets a flip-flop (FF) 65 when they coincide with each other. A comparator 64 compares the value of the X address 112 with the contents of the X2 register 62, and resets the flip-flop 65 when they coincide with each other. Similarly, a comparator 69 sets a flip-flop (FF) 71 when the value of the Y address 111 coincides with the contents of the Y1 register 67, and a comparator 70 resets the flip-flop 71 when the value of the Y address 111 coincides with the contents of the Y2 register 68. Accordingly, the flip-flop 65 remains in the set state during the period in which the X address falls within the range from Xl to X2, and the flip-flop 71 remains in the set state during the period in which the Y address falls within the range from Y1 to Y2. An AND circuit 66 sends the logical product of the outputs of the flip-flops 65 and 71 to the slectors 18–20 as the control signal 120. Thus, the control signal 120 takes a value "1" only in the period in which the flip-flops 65 and 71 are both set, that is, in the period in which the data is read out from the direct display area 52 of the bit map memory 15, and it takes a value "0" in the other period. As a result, the information in the direct display area 52 is displayed without being converted by the LUT 16, and the information in the converted display area 51 is displayed after it is converted by the LUT 16.

Where two or more direct display areas exist, it is sufficient to add the registers 61, 62, 67 and 68 for storing the coordinates of the boundary of the area and the comparators 63, 64, 69 and 70 in a set for every additional direct display area.

Figure 6:
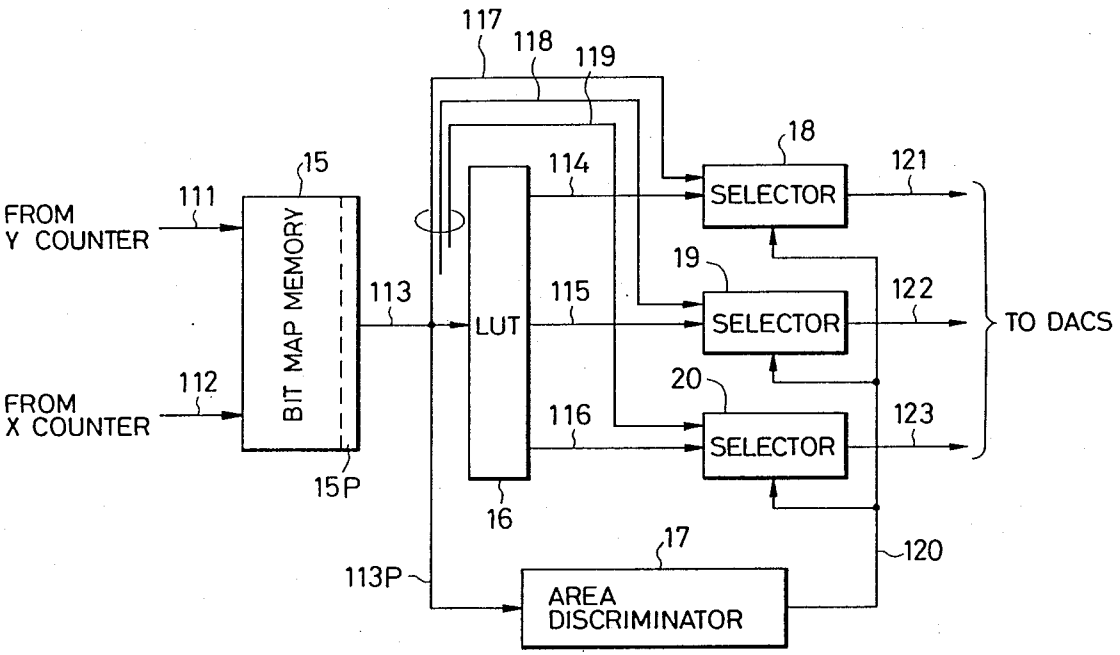
FIG. 6 is a block diagram of the main portion of another embodiment of the present invention.

FIG. 6 shows another embodiment of the present invention, depicting only the modified portions of FIG. 1. In the figure, the same reference numerals as those in FIG. 1 denote the corresponding components. In this embodiment, areas are specified by the data in the bit map memory 15. In the embodiment of FIG. 6, the direct display area 52 is indicated by setting the bit on a predetermined plane 15P of the bit map memory 15 to "1". The area discriminator 17 examines the bit signal 113P from the plane 15P in each picture element data 113 read out from the bit map memory 15, and sets the signal 120 to the selectors 18–20 to "0" or "1" according to the value of the bit 113P. Instead of the special plane 15P in the bit map memory 15, another memory or a register which is read stepwise in synchronism with the bit map memory 15 may be provided. By these arrangements, the indication of direct display or converted display is given to each picture element, and, accordingly, an area of any complicated shape can be specified.

The above-mentioned embodiments are for colored images. For monochromatic images, the slectors 18–20 and the DACs 21–23 are reduced to a single channel.

Figure 7:
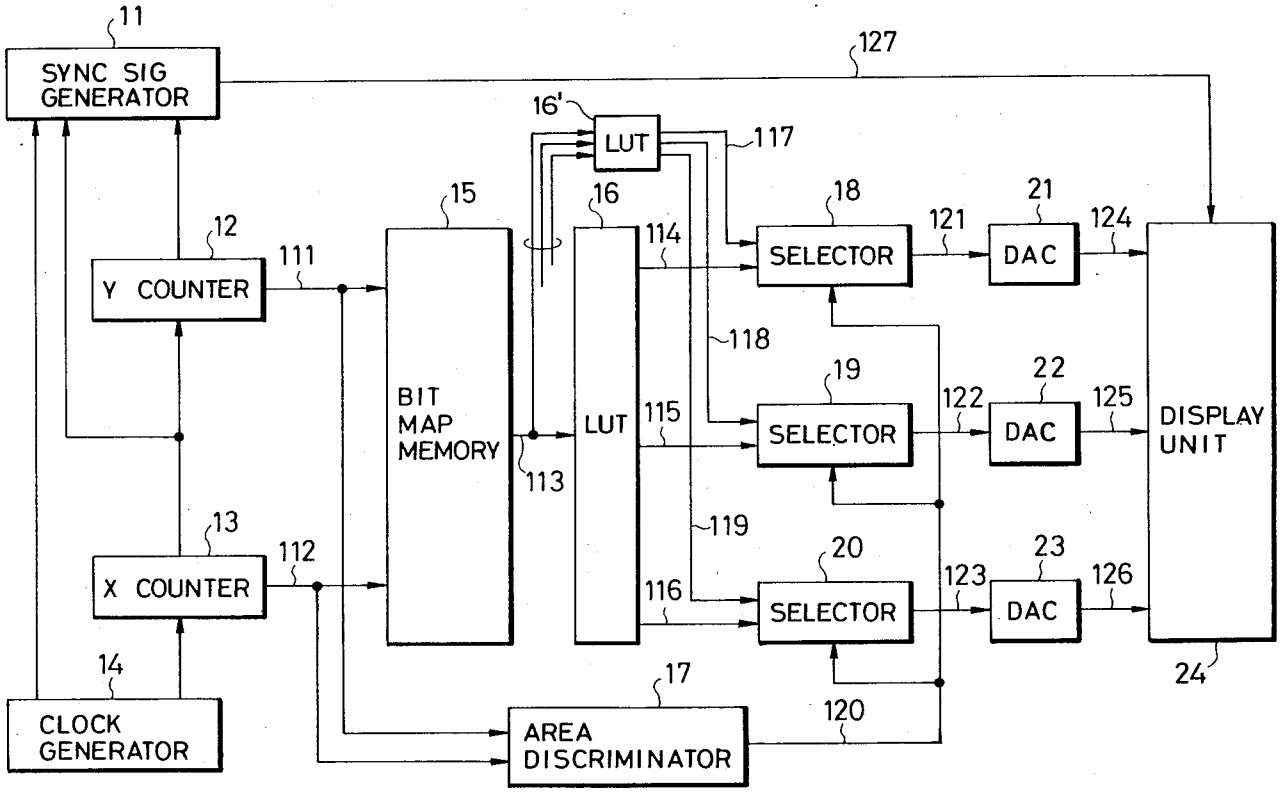
FIG. 7 is a block diagram of a modified embodiment of FIG. 2.
Figure 8:
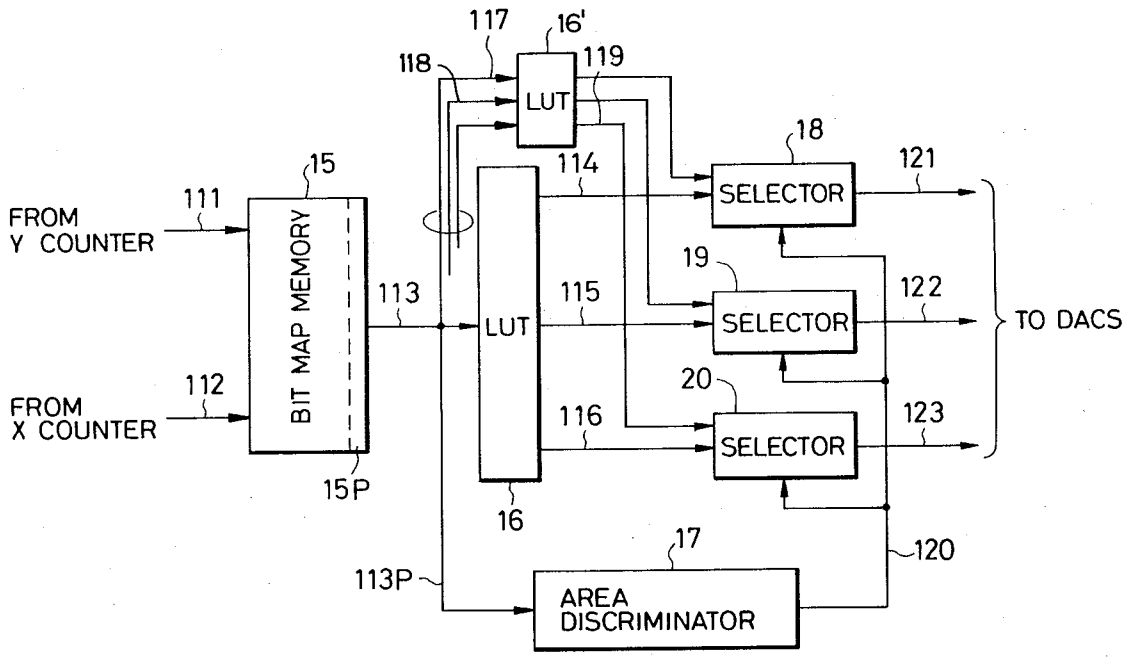
FIG. 8 is a block diagram of a modified embodiment of FIG. 6.

In two additional embodiments of the present invention illustrated in FIGS. 7 and 8, a plurality of LUTs 16 and 16' are provided, and the LUT through which the signal to the display unit passes is switched according to the specified area. FIGS. 7 and 8 are respectively modifications of FIGS. 2 and 6 with like parts being identified by like reference numerals. For instance, in FIG. 2 or FIG. 6, the inputs 117–119 of the selectors 18–20 are taken from the output of a second LUT 16' which receives the output 113 of the bit map memory 15 as the table index. It is believed that such modification in construction and the operation thereof are obvious to those skilled in the art, so the illustration and further explanation thereof are omitted.

The present invention facilitates variegated image processing such as the following.

(1) It is easy to compare and collate an image from a TV camera or the like and the related computer graphics output by putting them side by side. Such function can be applied, for instance, to the operation of comparing an image from the visual field of a work robot and an anticipated pattern by a computer to give necessary instructions.

(2) Particularly, according to the embodiment in which a display type is specified for each picture element, a computer graphics output and another image (e.g. photographic image) can be superimposed without a restriction on their shapes. Such unrestricted superimposition is effective, for instance, in games and animation.

We claim:

1. A control apparatus for a raster scan type display comprising a display unit, a bit map memory for storing picture element data in a plurality of locations to be read out successively for display in synchronism with scanning in said display unit, a look-up table connected to receive the picture element data read out of said bit map memory for converting said picture element data into video signals, means for holding information specifying at least one area of said bit map memory, means operatively connected to said holding means for determining whether a location in said bit map memory currently accessed for display is in the area specified by said area specifying information or not, and means for selectively sending in response to a determination by said determining means the picture element data directly from said bit map memory or the converted video signals from said look up table to said display unit.

2. A control apparatus for a raster scan type display comprising a display unit, a bit map memory for storing picture element data in a plurality of locations to be read out successively for display in synchronism with scanning in said display unit, a plurality of look-up tables each connected to receive the picture element data read out of said bit map memory for converting said picture element data into video signals for said display unit, means for holding address information specifying a boundary of an area of said bit map memory, means operatively connected to said holding means for determining on which side of said specified boundary a location in said bit map memory currently accessed for display resides by comparing said address information with the address of said currently accessed location, and means for selecting in response to a determination by said determining means the output of one of said look-up tables to send to said display unit.

3. A control apparatus according to claim 2, wherein said determining means comprises means for comparing the address information in said holding means with the address of said currently accessed location and bistable means changing its state in response to a coincidence of said address information and said currently accessed address detected by said comparing means, and said selecting means operates in response to the state of said bistable means.

4. A control apparatus for a raster scan type display comprising a display unit, a bit map memory for storing picture element data in a plurality of locations to be read out successively for display in synchronism with scanning in said display unit, a plurality of look-up tables each connected to receive the picture element data read out of said bit map memory for converting said picture element data into video signals for said display unit, means for holding bits corresponding to the respective locations in said bit map memory with said bits indicating whether the locations corresponding thereto are in a specified area or not, means operatively connected to said holding means for determining whether a location in said bit map memory currently accessed for display is in said specified area or not according to said bit corresponding to the currently accessed location, and means for selecting in response to a determination by said determining means the output of one of said look-up tables to send to said display unit.

5. A control apparatus according to claim 4, wherein said bit map memory comprises a plurality of memory planes each having a plurality of bit storage locations corresponding to respective picture element positions in said display unit, and said means for holding bits comprises at least one of said memory planes.

6. A control apparatus for a raster scan type display comprising a display unit, a bit map memory for storing picture element data in a plurality of locations to be read out successively for display in synchronism with scanning in said display unit, a look-up table connected to receive the picture element data read out of said bit map memory for converting said picture element data into video signals for said display unit, means for holding address information specifying a boundary of an area of said bit map memory, means operatively connected to said holding means for determining on which side of said specified boundary a location in said bit map memory currently accessed for display resides by comparing said address information with the address of said currently accessed location, and means for selectively sending in response to a determination by said determining means the picture element data directly from said bit map memory or the converted video signals from said look-up table to said display unit.

7. A control apparatus according to claim 6, wherein said determining means comprises means for comparing the address information in said holding means with the address of said currently accessed location and bistable means changing state in response to a coincidence of said address information and said currently accessed address detected by said comparing means, and said selecting means operates in response to the state of said bistable means.

8. A control apparatus for a raster scan type display comprising a display unit, a bit map memory for storing picture element data in a plurality of locations to be read out successively for display in synchronism with scanning in said display unit, a look-up table connected to receive the picture element data read out of said bit map memory for converting said picture element data into video signals for said display unit, means for holding bits corresponding to the respective locations in said bit map memory with said bits indicating whether the locations corresponding thereto are in a specified area or not, means operatively connected to said holding means for determining whether a location in said bit map memory currently accessed for display is in said specified area or not according to said bit corresponding to the currently accessed location, and means for selectively sending in response to a determination by said determining means the picture element data directly from said bit map memory or the converted video signals from said look-up table to said display unit.

9. A control apparatus according to claim 8, wherein said bit map memory comprises a plurality of memory planes each having a plurality of bit storage locations corresponding to respective picture element positions in said display unit, and said means for holding bits comprises at least one of said memory planes.

* * * * *